US010414639B2

(12) United States Patent
Downs

(10) Patent No.: US 10,414,639 B2
(45) Date of Patent: Sep. 17, 2019

(54) WINCH ASSEMBLY

(71) Applicant: Dutton-Lainson Company, Hastings, NE (US)

(72) Inventor: Joseph C. Downs, Lexington, KY (US)

(73) Assignee: DUTTON-LAINSON COMPANY, Hastings, NE (US)

( * ) Notice: Subject to any disclaimer, the term of this patent is extended or adjusted under 35 U.S.C. 154(b) by 301 days.

(21) Appl. No.: 15/226,591

(22) Filed: Aug. 2, 2016

(65) Prior Publication Data

US 2017/0036895 A1 Feb. 9, 2017

Related U.S. Application Data

(60) Provisional application No. 62/202,531, filed on Aug. 7, 2015.

(51) Int. Cl.

| | |
|---|---|
| ***B66D 1/04*** | (2006.01) |
| ***B66D 1/28*** | (2006.01) |
| ***B66D 1/06*** | (2006.01) |

(52) U.S. Cl.

CPC ..... *B66D 1/04* (2013.01); *B66D 1/06* (2013.01); *B66D 1/28* (2013.01)

(58) Field of Classification Search

CPC ... B66D 1/04; B66D 1/06; B66D 1/28; B66D 1/12; B66D 1/14

See application file for complete search history.

(56) References Cited

U.S. PATENT DOCUMENTS

| | | | | | |
|---|---|---|---|---|---|
| 747,401 | A * | 12/1903 | Foltz | B66D 1/26 | 254/310 |
| 3,220,701 | A * | 11/1965 | Clausen | B66D 1/06 | 254/359 |
| 3,939,729 | A | 2/1976 | Brockelsby | | |
| 4,106,754 | A * | 8/1978 | Kucher | B66D 1/06 | 114/251 |
| 5,961,061 | A * | 10/1999 | Stanley | B60P 7/0846 | 24/545 |
| 6,116,580 | A * | 9/2000 | Hull | B66D 1/06 | 254/357 |
| 7,017,887 | B1 * | 3/2006 | Verakis | B66D 1/12 | 254/342 |
| 7,159,852 | B2 * | 1/2007 | Dow | B66D 1/04 | 254/237 |

(Continued)

*Primary Examiner* — Michael E Gallion

(74) *Attorney, Agent, or Firm* — Michael S. Hargis; King & Schickli, PLLC

(57) ABSTRACT

A winch assembly includes a lower body having a base, first and second sides, first and second upper body sides, a spacer positioned between the first and the upper body second sides, a first shaft extending through the upper body sides, the first shaft supporting first and second gears, a winding bar supported and rotated by the first shaft and attached to a first end of a strap, a second shaft extending through the first and second upper body sides and supporting first and second ratchet gears, the first ratchet gear meshing with the first gear and the second ratchet gear meshing with the second gear, a pawl for engaging one of the first and second ratchet gears, and a handle attached to the second shaft for rotating the second shaft, wherein rotation of the second shaft imparts rotation of the first and second ratchet gears and the first and second gears.

22 Claims, 10 Drawing Sheets

(56) References Cited

U.S. PATENT DOCUMENTS

| | | | | |
|---|---|---|---|---|
| 7,766,271 | B1 * | 8/2010 | Confoey | B60P 7/0846<br>24/68 CD |
| 7,793,919 | B2 * | 9/2010 | Guyard | B66D 5/18<br>254/345 |
| 7,967,278 | B2 * | 6/2011 | Anderson | B60P 3/1066<br>254/342 |
| 7,984,870 | B2 * | 7/2011 | Gonzales | B60P 7/0846<br>242/404.1 |
| 8,695,945 | B2 * | 4/2014 | Guyard | B66D 1/06<br>254/342 |
| 8,720,865 | B2 * | 5/2014 | Anderson | B66D 1/04<br>254/342 |
| 2005/0092862 | A1 * | 5/2005 | Treat | B60P 7/0846<br>242/395 |
| 2009/0236458 | A1 * | 9/2009 | Rodrique | B60P 7/0846<br>242/374 |
| 2017/0362066 | A1 * | 12/2017 | Grapes | B66D 1/06 |

* cited by examiner

WINCH ASSEMBLY

This application claims the benefit of U.S. Provisional Application No. 62/202,531, filed Aug. 7, 2015.

TECHNICAL FIELD

The present invention relates generally to winch assemblies for towing trailers, and more particularly, to a winch assembly having improved functionality, ease of use, and ease of assembly and maintenance.

BACKGROUND

Towing trailers are designed to secure and haul cargo. Trailers may be arranged to haul specific types of cargo such as boats, automobiles, consumer products, and the like. Many such cargo items are large, heavy and difficult to move or maneuver onto the bed or frame of a towing trailer. To assist in moving or maneuvering the cargo onto a towing trailer, such trailers are often equipped with a winch. The winch assembly is commonly attached to the tongue of the trailer. The winch may be connected to a cargo item by, for example, a strap, cable, rope, chain or the like for pulling the cargo item to and onto the trailer. Winch assemblies typically use a handle to rotate a drum to wind the strap or cable around the drum and thus pull the cargo item towards the winch. The winch assembly may also be used to unload a heavy item by rotating the drum in the opposite direction to unwind a strap or chain to allow the cargo item to be slid off the trailer.

SUMMARY OF THE INVENTION

In accordance with the purposes and benefits described herein, a winch assembly is provided. The winch assembly may be broadly described as comprising a lower body having a base, and first and second sides, first and second upper body sides, at least one spacer positioned between the first and the upper body second sides, a first shaft extending through the first and second upper body sides, the first shaft supporting first and second gears, a winding bar supported and rotated by the first shaft, the winding bar attached to a first end of a strap, a second shaft extending through the first and second upper body sides, the second shaft supporting first and second ratchet gears, the first ratchet gear meshing with the first gear and the second ratchet gear meshing with the second gear, a pawl for engaging one of the first and second ratchet gears, and a handle attached to the second shaft for rotating the second shaft, wherein rotation of the second shaft imparts rotation of the first and second ratchet gears and the first and second gears.

In another possible embodiment, the winch assembly further includes a cover.

In still another possible embodiment, the first upper body side is attached to the lower body first side, and the second upper body side is attached to the lower body second side. In another, the pawl is configured to allow movement of the first and second ratchet gears in two directions.

In yet another possible embodiment, the winch assembly further includes a hook attached to a second end of the strap, and a protective covering. In another, the strap is looped through a hole in the hook, and further comprising a fastener for securing the protective covering adjacent the hole. In yet another, the first and second upper body sides include interior and exterior surfaces.

In one other possible embodiment, the first gear is positioned adjacent the exterior side of the first upper body side, and the second gear is positioned adjacent the exterior side of the second upper body side. In still another, the first upper body side is attached to the lower body first side, and the second upper body side is attached to the lower body second side.

In yet still another possible embodiment, the cover is attached to the first and second upper body sides. In another, the first and second upper body sides and the first and second gear are positioned within the cover. In still another, the cover includes at least one access door.

In another possible embodiment, the winding bar includes first and second arms, each of the first and second arms including an aperture therein through which the first shaft extends. In another, the winch assembly further includes a first spacer positioned between the first and second winding bar arms and through which the first shaft extends.

In still another possible embodiment, the winch assembly further includes a second spacer extending through the first upper body side, and positioned between the first arm and the first gear, and a third spacer extending through the second upper body side, and positioned between the second arm and the second gear.

In another, the at least a portion of the first shaft extending through the first upper body the first gear includes a flat side and a threaded side, and, in yet another, the at least a portion of the first shaft extending through the second upper body and the second gear includes a flat side and a threaded side.

In yet still another possible embodiment, the at least one of the second and third spacers include an aperture. In another, the winch assembly further includes a lubricant positioned between the first and second and third spacers and the flat sides of the first and second shafts.

In one additional alternate embodiment, the winch assembly further includes a pair of bushings, a first bushing secured within the first upper body side and a second bushing secured within the second upper body side, wherein the second spacer extends through the first bushing and the third space extends through the second bushing. In another, the at least a portion of the first shaft extending through the first upper body the first gear includes a flat side and a threaded side. In still another, the at least a portion of the first shaft extending through the second upper body and the second gear includes a flat side and a threaded side.

In another possible embodiment, the handle is removable.

In the following description, there are shown and described several embodiments of winch assemblies. As it should be realized, the methods and systems are capable of other, different embodiments and their several details are capable of modification in various, obvious aspects all without departing from the methods and assemblies as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the winch assembly and together with the description serve to explain certain principles thereof. In the drawing figures.

Reference will now be made in detail to the present embodiments of the winch assembly, examples of which are illustrated in the accompanying drawing figures, wherein like numerals are used to represent like elements.

DETAILED DESCRIPTION

Figure 1:
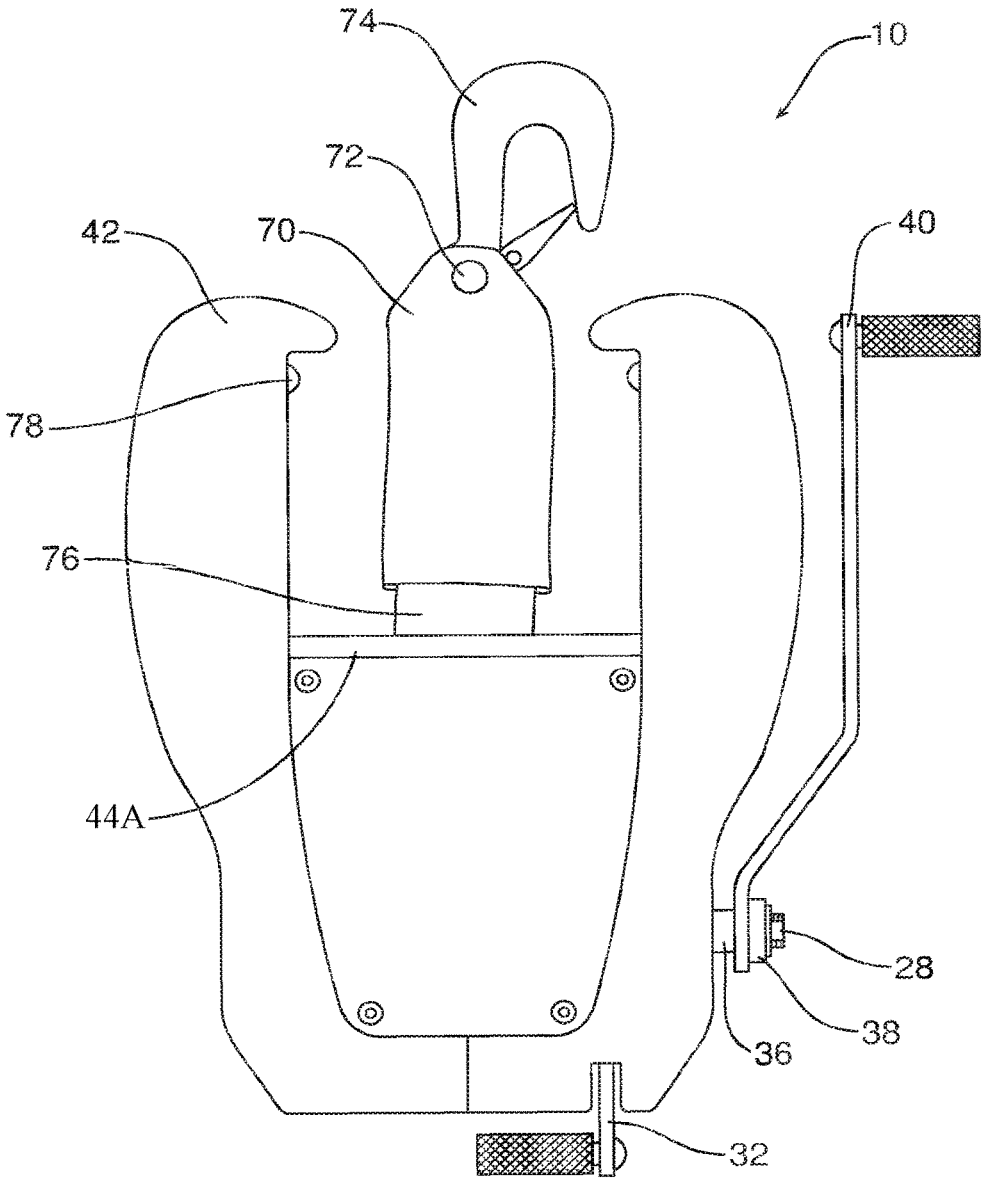
FIG. 1 is a top view of a winch assembly.
Figure 6:
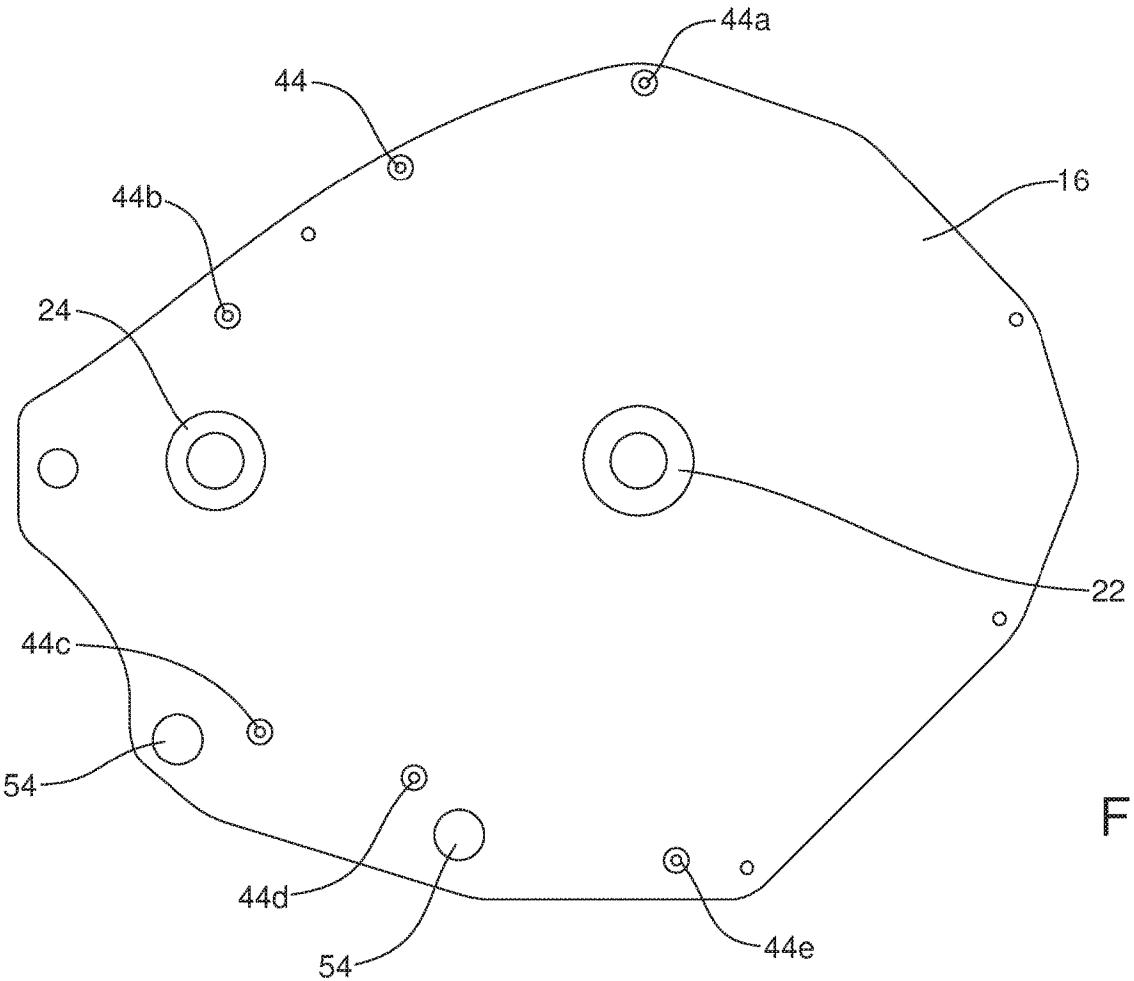
FIG. 6 is a side view of a partial winch upper body of a winch assembly.

A winch assembly 10 is illustrated in FIG. 1. The winch assembly 10 includes a handle or crank 40, a protective outer covering 42 that covers the internal components of the winch assembly 10. The handle 40, is attached to input shaft 28, to facilitate the manual rotation of the pinion gears 30. As shown in FIG. 6, the winch upper body sides 16 and 16A, also include apertures 54, for mounting to a lower winch body bracket 48 (shown in FIGS. 3 and 4*a*), that is configured to facilitate the securing or attaching of the winch assembly 10 to a winch stand or directly to a towing trailer, for example.

Figure 3:
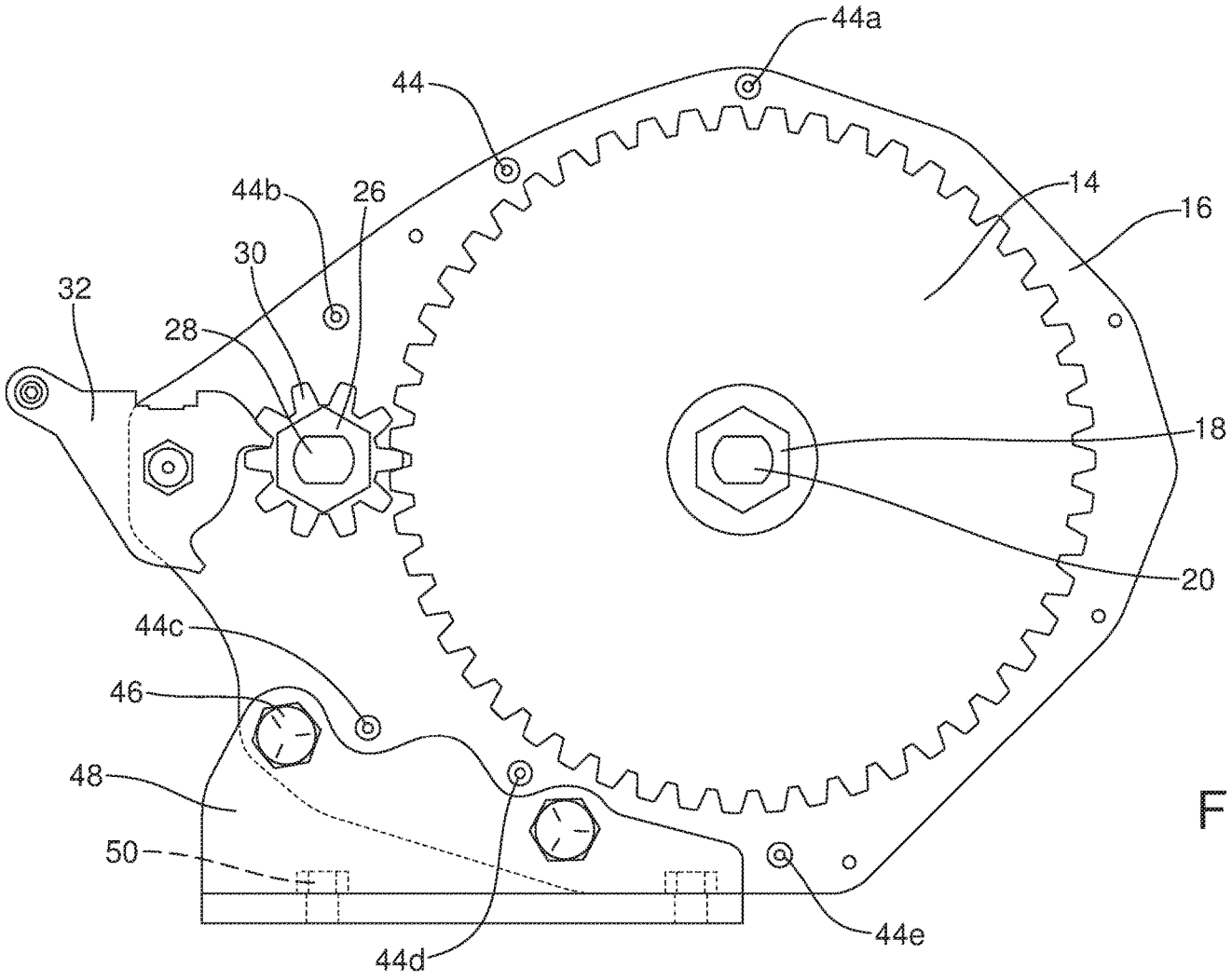
FIG. 3 is a cutaway side view of the winch assembly.

Most trailer winch bodies or frames are manufactured to include the mounting means therein. However, such a configuration severely limits the features and mounting options that can be incorporated into the design. In addition, most trailer winches use a drum with incorporated drive gears. This drum configuration severely limits design, construction, assembly and mounting options. As best seen in FIG. 3, the winch upper body sides 16 and 16A in the described invention are fabricated as a separate component. Such an arrangement incorporates many desirable features, allows for more mounting options, provides for a high strength construction, and makes manufacturing and mounting easier.

Figure 2:
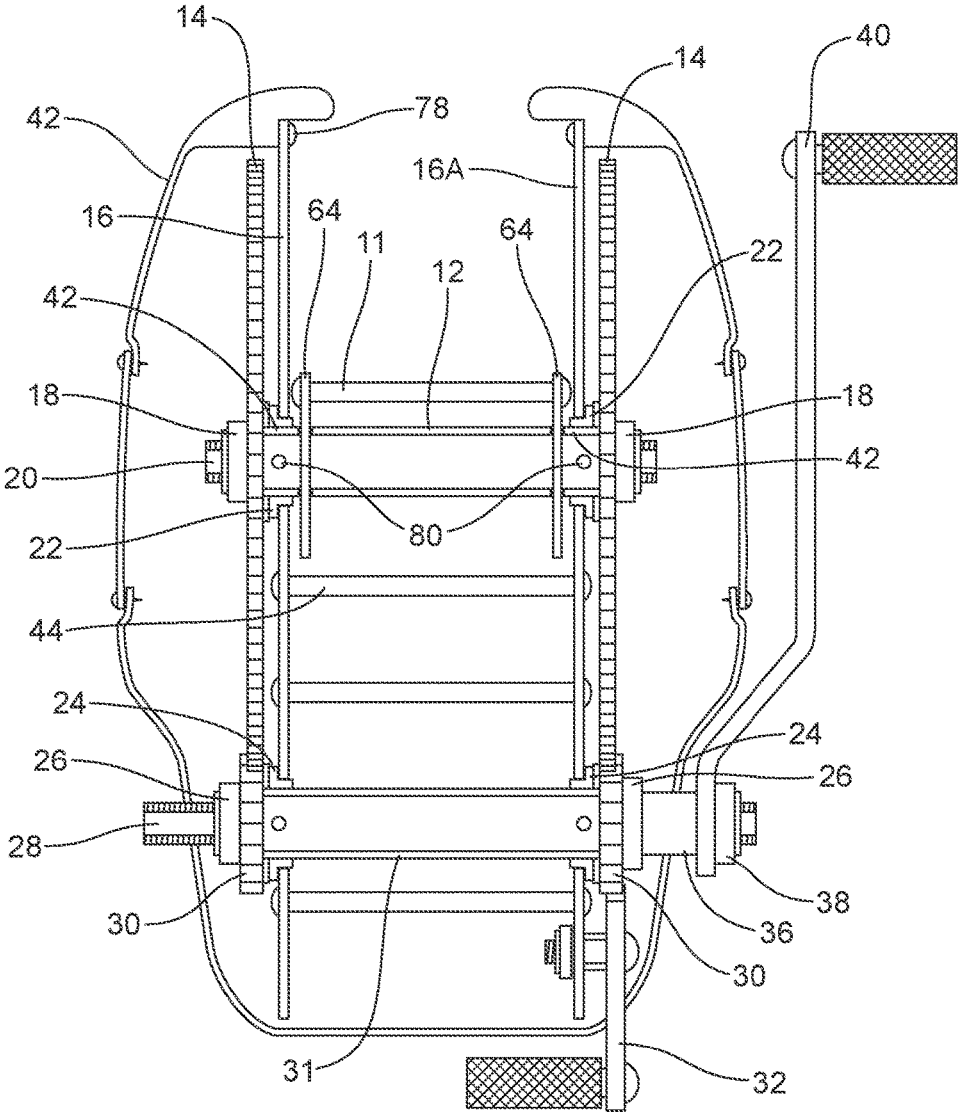
FIG. 2 is a cutaway top view showing internal mechanisms of the winch assembly.

As shown in FIGS. 2 and 3, the winch assembly 10 further includes a winding bar 11 and a ratchet and pawl system 32. The winding bar 11 and ratchet and pawl system 32 are supported by the winch upper body sides 16 and 16A for selectively driving and locking the winding bar 11. The winch assembly 10 is arranged to load and unload cargo onto a towing trailer by securing a strap to the cargo.

The strap is attached to the winding bar 11 and pulls cargo onto the trailer when the winding bar 11 is rotated in a first direction and allows cargo to slide off the trailer when the winding bar 11 is rotated in a second and opposite direction. The winding bar 11 is located within the winch upper body sides 16 and 16A and is positioned on a shaft 20, by use of collars, spacers or threaded fasteners for example. The winding bar 11 is driven by the manual rotation of the handle 40. To accommodate driving of the winding bar 11 to load and unload cargo, an input and transfer system is provided. As will be described in detail below, the winch input and transfer system operates outside of the winch upper body sides 16 and 16A and is driven by a hand operated crank handle 40 in the described embodiment.

In one embodiment, the drive system includes an input shaft 28, a pair of bushings 24, an input shaft spacer 31, pinion gears 30, and securing members 26. Securing members 26 in the described embodiment are threaded and positioned to hold the input shaft 28 in order to form a captured input system. The input shaft 28 has at least one flat side and one threaded side. The pinion gears 30 are slip fit onto the input shaft 28.

The bushings 24 have a generally circular outer surface, a generally circular inner surface, and include a flange. The bushings 24 slide into coaxial apertures in the winch upper body sides 16 and 16A. The upper body apertures are arranged to match the generally circular outer surface of the bushing 24 so that the bushing 24 can rotate when located in the upper body aperture. In another embodiment, the bushings 24 may be fabricated from an oil impregnated self-lubricating bronze material. Such an arrangement provides for an extended service life.

The input shaft spacer 31 has a generally circular outer surface. As shown, input shaft spacer 31 extends through bushings 24, where the outer surface edge of input shaft spacer 31 contacts inner surface of pinion gears 30, where the outer surface edge of pinion gears 30 contacts the inner surface of securing members 26. The input shaft spacer 31 are formed with holes 29, to facilitate lubricant release onto inner surface of bushings 24. In another embodiment, the void between the flat side of input shaft 28 and spacer 31 may be filled with lubricant. Such an arrangement again is intended to provide for an extended service life.

As shown, the outer bushings 24 support the input shaft 28 within the winch upper body sides 16 and 16A. The combination of the spacer 31, pinion gears 30 and securing members 26 functionally secures the input shaft 28 within, through and outside of the outer bushing 24 located in apertures of the winch upper body sides 16 and 16A. This configuration sets clearance and side tolerances while allowing rotation of input shaft 28.

Figure 8:
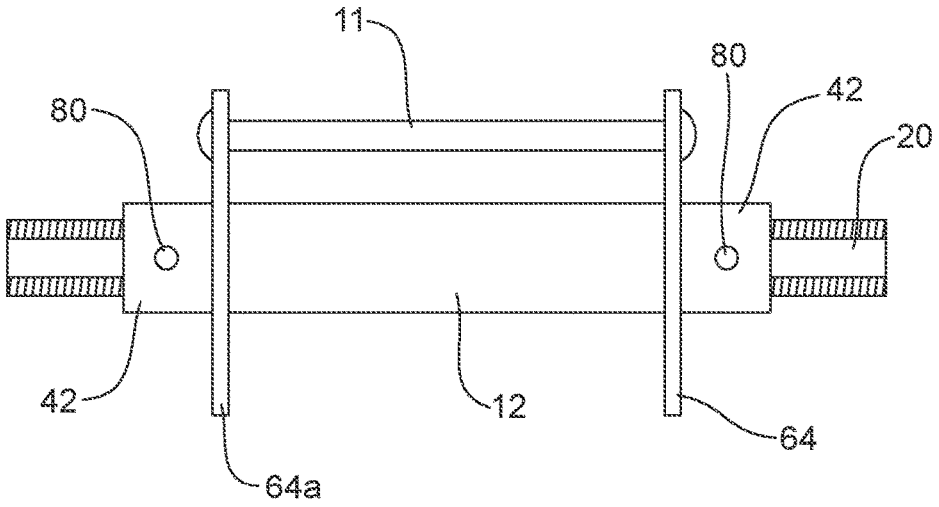
FIG. 8 is a perspective view of a winding bar for the winch assembly.
Figure 9:
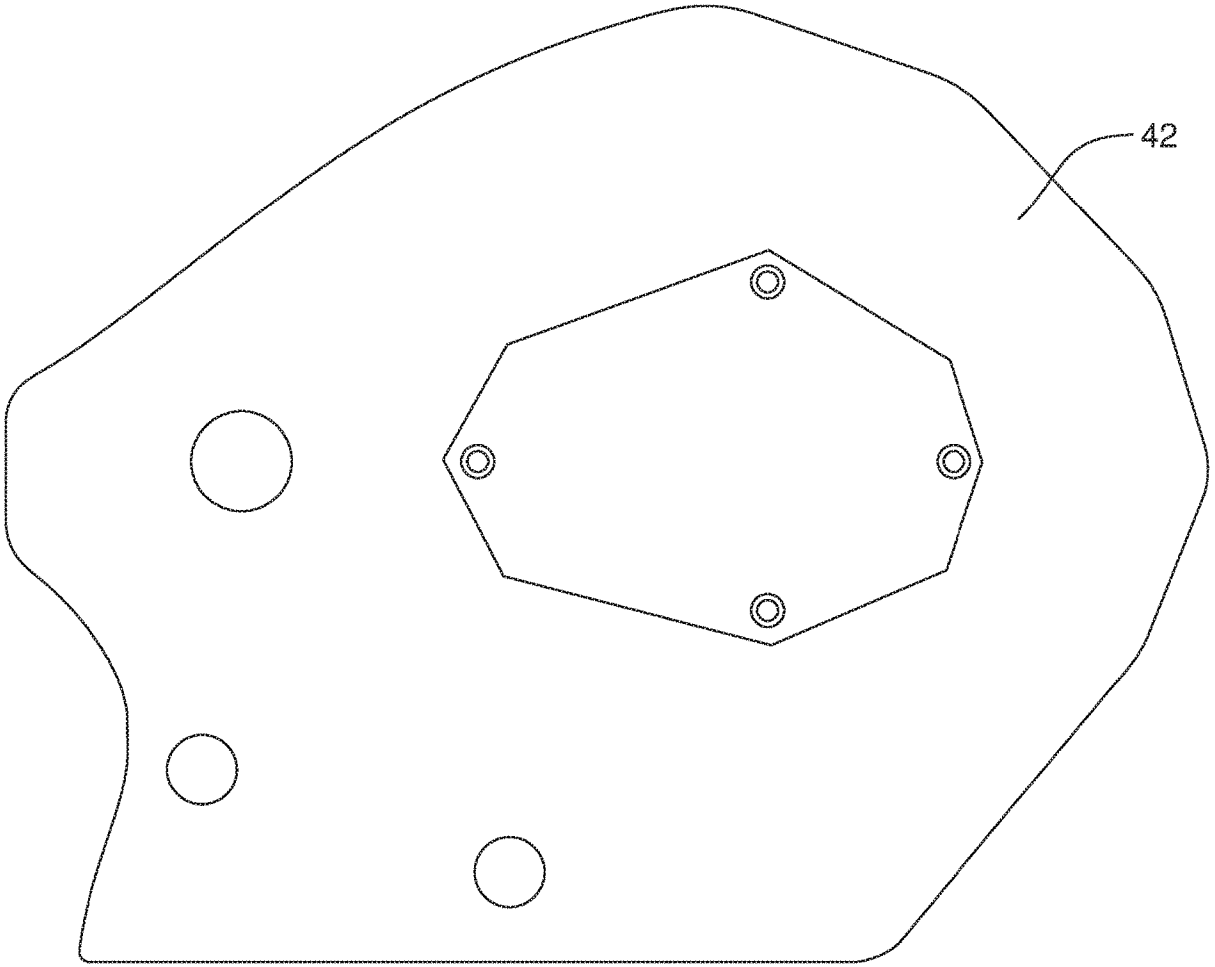
FIG. 9 is a side view of an outer covering of the winch assembly.
Figure 10:
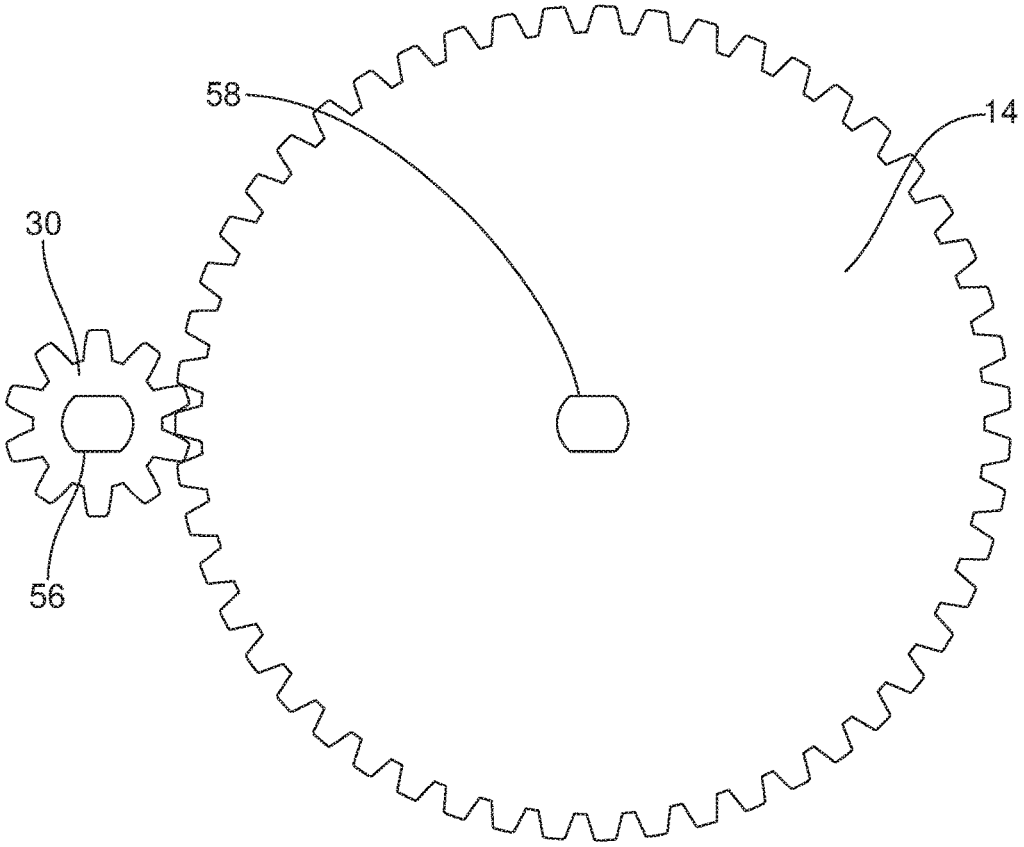
FIG. 10 illustrates a side view of a pinion and transfer gear of the winch assembly.

The pinion gears 30 positioned on the input shaft 28 are arranged to drive the transfer gears 14 and to facilitate the locking of the winding bar 11. The pinion gears 30 are positioned outside of the winch upper body sides 16 and 16A. The pinion gears 30 engage the transfer gears 14 to drive the transfer shaft 20. In the described embodiment, the transfer shaft 20 has at least one flat side and one threaded side although other arrangements are possible. The winding bar spacer 12 slips over the transfer shaft 20 and is captured between winding bar sides or arms 64 and 64A which are transverse to the shaft as best shown in FIG. 8. Transfer shaft spacers 42 slip fit onto transfer shaft 20 contacting the outer surface of winding bar sides 64 and 64A and the inner surface of transfer gears 14. Securing members 18 thread onto transfer shaft 20 and contact the outer surface of transfer gears 14. Transfer shaft spacers 42 are formed with holes 80 to facilitate lubricant release onto inner surface of bushings 22. In one embodiment, the void between the flat side of transfer shaft 20 and spacers 42 may be filled with lubricant. Such an arrangement is intended to provide for an extended service life.

As discussed above, the transfer gears 14, include an aperture 58 symmetrically positioned at the center of transfer gears 14. The transfer gears 14, are slip fit over transfer shaft 20 outside the winch upper body sides 16 and 16A. Such attachment eliminates the need for welding, riveting, or otherwise securing gears to a drum or a drum itself.

Figure 7:
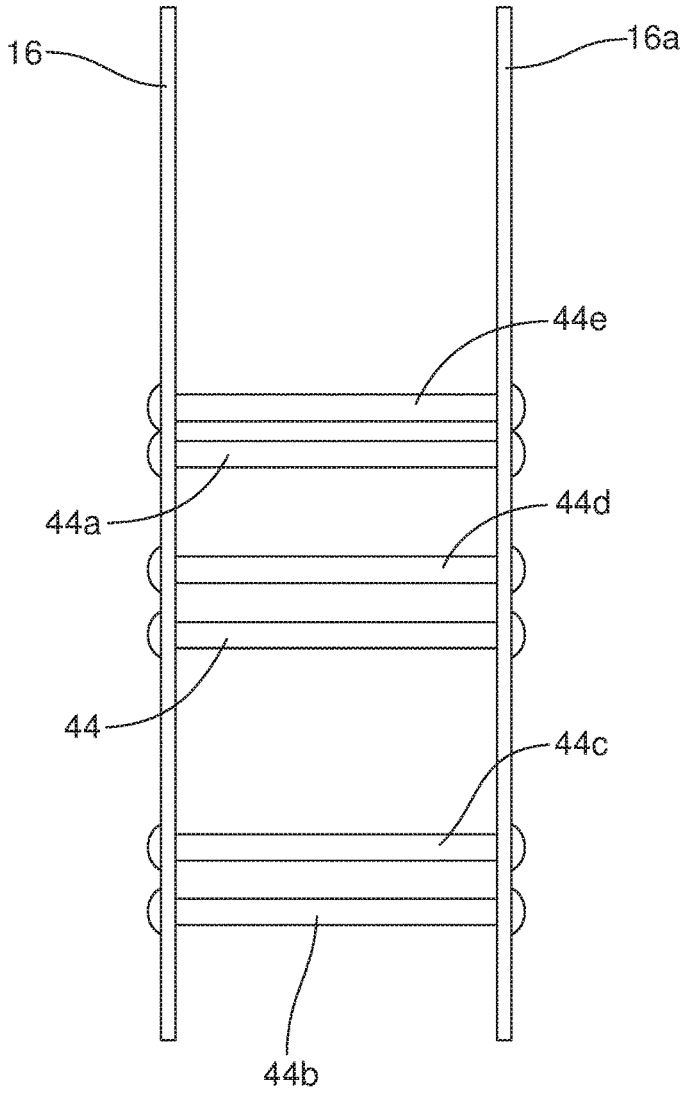
FIG. 7 is a top view of the partial winch upper body assembly.

As best shown in FIGS. 6 and 7, winch upper body sides 16 and 16A contain apertures for receiving spacing members 44, 44A, 44B, 44C, 44D, and 44E. Winch upper body sides 16 and 16A contain apertures for receiving winch cover securing members 78.

Such an arrangement results in elimination of instances when the strap can engage or becoming entangled with the transfer gears 14 which would cause damage and other wear along with potentially contaminating the strap with grease. In addition, as will be described in detail below, the strap protector 70 also prevents at least part of the strap 76 and strap hook 74 from contacting winch upper body sides 16 and 16A further protecting the strap from wear and or contamination.

Figure 5:
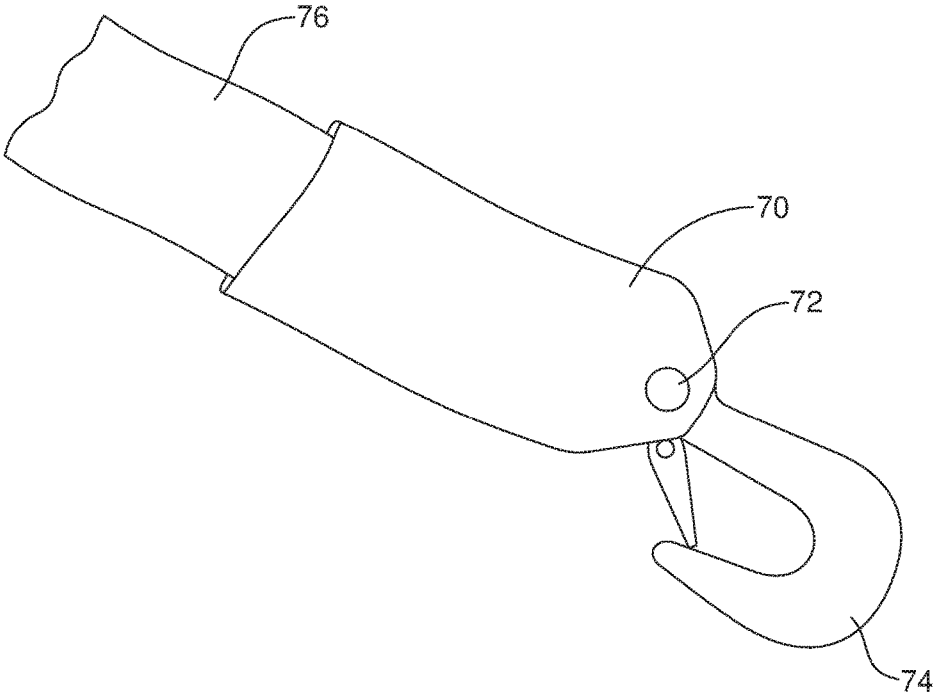
FIG. 5 is a perspective view of a strap protector of a winch assembly.

The winch assembly 10 may also include a strap 76 with a strap protector 70, strap protector securing device 72, and strap hook 74. As best shown in FIG. 5, the strap protector 70 is secured to overlap union point of strap 76 and strap hook 74.

The winch assembly 10 may be arranged so that it may be secured to a towing trailer or a winch stand without accessing the inside of the winch cover 42. Such an arrangement provides for easy and quick installation of a winch assembly 10 without concern for opening or accessing the cover 42, unwinding the strap, etc. The winch assembly 10 may be installed using fasteners such as bolts 50, through the bottom of lower winch body bracket 48, and winch body connection members 46, through the apertures 54 of winch upper body sides 16 and 16A, of the winch assembly 10.

Figure 4A:
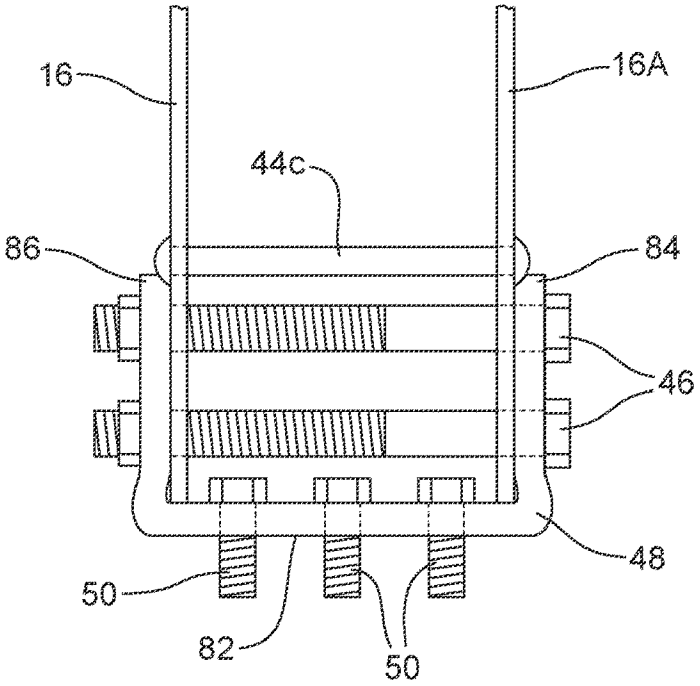
FIG. 4A is an end view of the lower winch body bracket of a winch assembly.

As best shown in FIGS. 3 and 4A, the winch assembly 10 includes an easy install system. In a traditional mounting application, the fasteners have to be installed through the inside of the winch. This is oftentimes cumbersome due to several components on the inside of the winch. Accessing the mounting holes is even more difficult when a winch line is fully wound onto the drum. With this limited inside access, being able to hold down the head of the bolts is sometimes a problem when trying to tighten the nuts from the bottom side. Sometimes parts of the winch may need to be disassembled to complete the installation. The present invention avoids these issues as described below.

Figure 4:
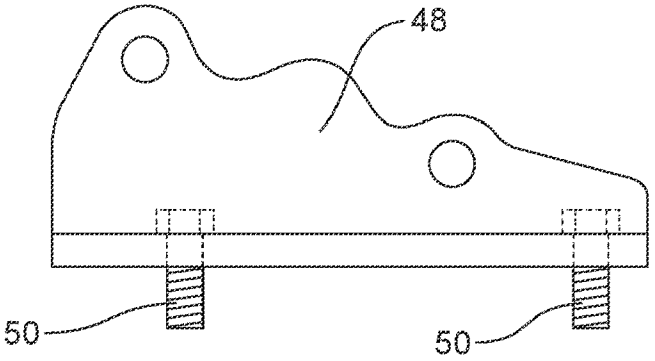
FIG. 4 is a side view of the lower winch body bracket of the winch assembly.

In the described invention, an installer inserts bolts 50 from the top of lower winch body or lower winch body bracket 48 into a trailer winch or mounting stand. More specifically, the bolts 50 are inserted through a base 82 of the lower winch body bracket 48 as shown in FIGS. 4 and 4*a*. The upper body sides 16 and 16A are secured between first and second sides 84, 86 of the lower winch body by winch body connection members 46 from either side as shown in FIG. 4*a*.

In summary, numerous benefits result from the winch assembly as illustrated in this document. The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A winch assembly, comprising:

a bracket having a base, and first and second sides;

first and second sides;

at least one spacer positioned between said first and second sides;

a first shaft extending through said first and second sides, said first shaft supporting first and second gears;

a winding bar supported by first and second transverse arms, said first and second arms extending from and rotated by said first shaft, said winding bar attached to a first end of a strap;

a second shaft extending through said first and second sides, said second shaft supporting first and second ratchet gears, said first ratchet gear meshing with said first gear and said second ratchet gear meshing with said second gear;

a pawl for engaging one of said first and second ratchet gears; and a handle attached to said second shaft for rotating said second shaft, wherein rotation of said second shaft imparts rotation of said first and second ratchet gears and said first and second gears.

2. The winch assembly of claim 1, further comprising a cover.

3. The winch assembly of claim 1, wherein said first side is attached to said bracket first side, and said second side is attached to said bracket second side.

4. The winch assembly of claim 3, wherein said pawl is configured to allow movement of said first and second ratchet gears in two directions.

5. The winch assembly of claim 1, further comprising a hook attached to a second end of said strap, and a protective covering for said strap.

6. The winch assembly of claim 5, wherein said strap is looped through a hole in said hook, and further comprising a fastener for securing said protective covering adjacent said hole.

7. The winch assembly of claim 1, wherein said first and second sides include interior and exterior surfaces.

8. The winch assembly of claim 7, wherein said first gear is positioned adjacent said exterior side of said first side, and said second gear is positioned adjacent said exterior side of said second side.

9. The winch assembly of claim 8, wherein said first side is attached to said bracket first side, and said second side is attached to said bracket second side.

10. The winch assembly of claim 9, wherein said pawl is configured to allow movement of said first and second ratchet gears in two directions.

11. The winch assembly of claim 8, further comprising a cover.

12. The winch assembly of claim 11, wherein said cover is attached to said first and second upper body sides.

13. The winch assembly of claim 12, wherein said first and second upper body sides and said first and second gear are positioned within said cover.

14. The winch assembly of claim 1, further comprising a first spacer positioned between said first and second winding bar arms and through which said first shaft extends.

15. The winch assembly of claim 14, further comprising a second spacer extending through said first side, and positioned between said first arm and said first gear, and a third spacer extending through said second side, and positioned between said second arm and said second gear.

16. The winch assembly of claim 15, wherein at least a portion of said first shaft extending through said first side and said first gear includes a flat side and a threaded side.

17. The winch assembly of claim 16, wherein at least a portion of said first shaft extending through said second side and said second gear includes a flat side and a threaded side.

18. The winch assembly of claim 15, further comprising a pair of bushings, a first bushing secured within said first side and a second bushing secured within said second side, wherein said second spacer extends through said first bushing and said third space extends through said second bushing.

19. The winch assembly of claim 18, wherein at least a portion of said first shaft extending through said first side and said first gear includes a flat side and a threaded side.

20. The winch assembly of claim 19, wherein at least a portion of said first shaft extending through said second side and said second gear includes a flat side and a threaded side.

21. The winch assembly of claim 1, wherein said handle is removable.

22. A winch assembly, comprising:

a bracket having a base, and first and second sides;

a first side attached to the first bracket side and a second side attached to the second bracket side;

at least one spacer positioned between the first and second sides;

a first shaft extending through the first and second sides, the first shaft supporting first and second gears;

a winding bar attached to a first end of a strap and rotated by the first shaft;

a second shaft extending through said first and second sides, the second shaft supporting first and second ratchet gears, the first ratchet gear meshing with the first gear and the second ratchet gear meshing with the second gear;

a pawl for engaging one of the first and second ratchet gears; and a handle attached to the second shaft for rotating the second shaft, wherein the first and second sides are inboard of the first and second gears.

* * * * *